United States Patent [19]

Long

[11] 3,987,785

[45] Oct. 26, 1976

[54] ENERGY SAVING DEVICE

[76] Inventor: LeBeau M. Long, 140 Boylston St., Boston, Mass. 02116

[22] Filed: Mar. 21, 1975

[21] Appl. No.: 560,606

[52] U.S. Cl. ..... 126/296; 110/163; 236/45

[51] Int. Cl.[2] ..... F23L 13/00

[58] Field of Search ..... 110/97 R, 163; 236/45; 126/296

[56] References Cited

UNITED STATES PATENTS

| | | | |
|---|---|---|---|
| 688,836 | 12/1901 | Diehl | 126/296 |
| 993,381 | 5/1911 | Kennedy | 126/296 |
| 1,286,489 | 12/1918 | Anderson | 236/45 |
| 2,684,647 | 7/1954 | Bither | 110/163 |

*Primary Examiner*—Kenneth W. Sprague
*Attorney, Agent, or Firm*—Wolf, Greenfield & Sacks

[57] ABSTRACT

The device is a baffle array that is housed in a section of pipe that coupled from an oil burner to a chimney. The baffle array, when closed, blocks about 70 percent of the pipe cross-sectional area and opens upon the occurrence of a small explosion when the oil burner starts to permit this explosive puff to pass to the chimney. The baffle array includes three baffle plates, each pivoting at its top end and all interconnected at the bottom end.

1 Claim, 4 Drawing Figures

FIG. 1A
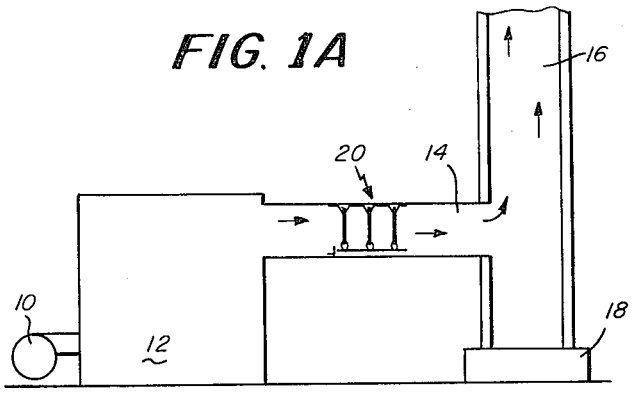
FIG. 1B
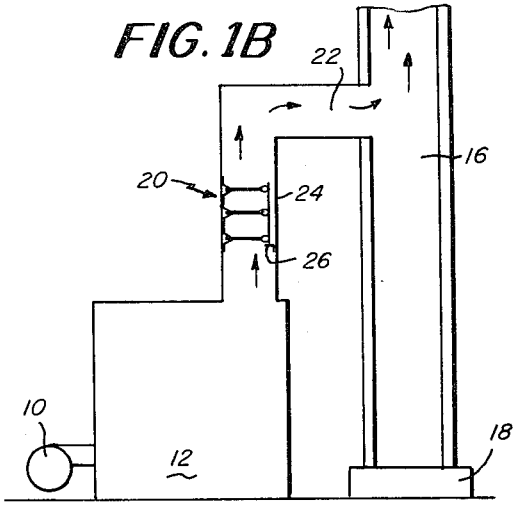
FIG. 2
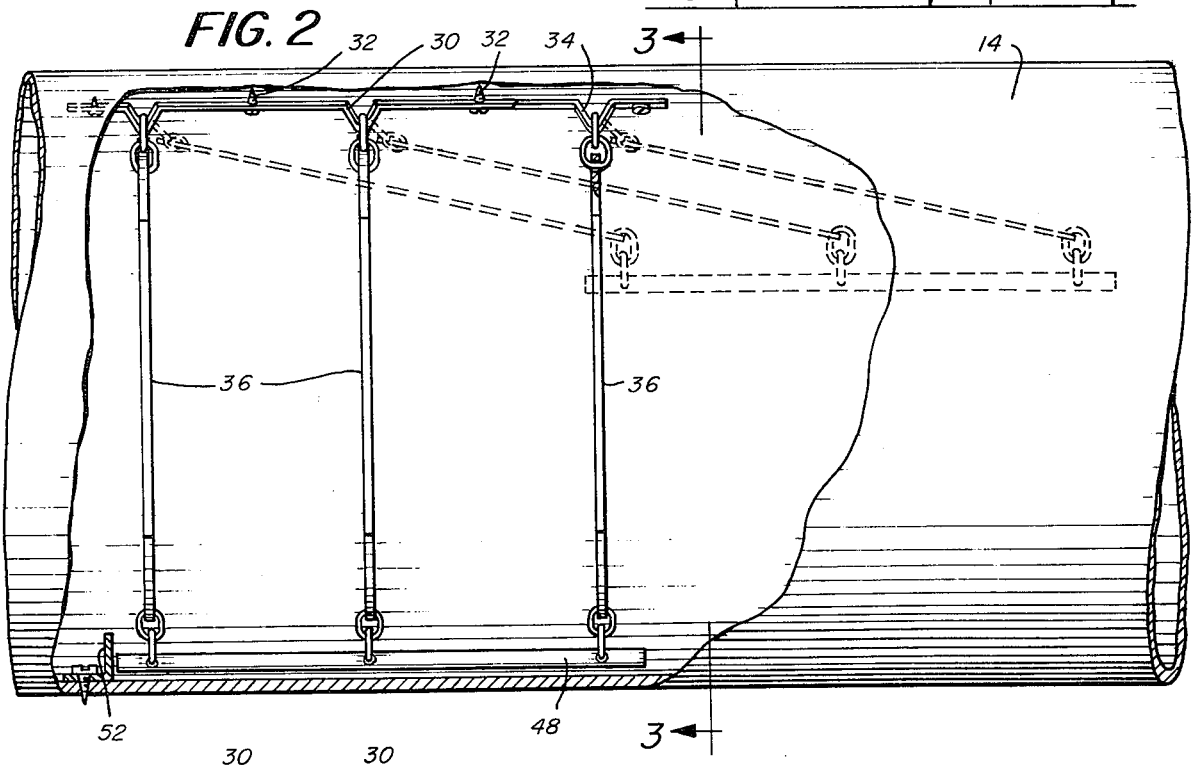
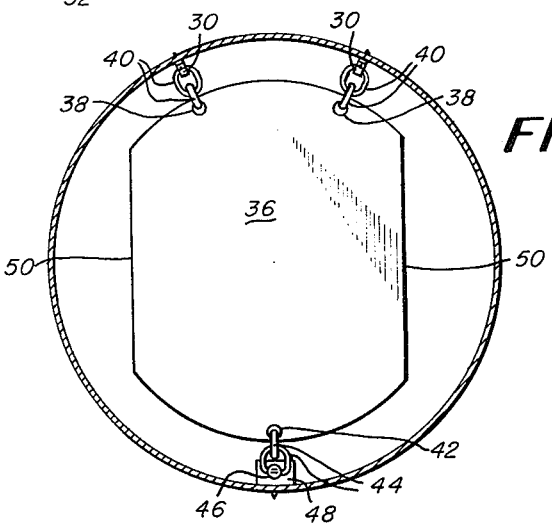
FIG. 3

ENERGY SAVING DEVICE

BACKGROUND OF THE INVENTION

The present invention relates, in general, to a device for conserving energy. More particularly, this invention relates to a baffle structure for use in the vent pipe of a heating system for reducing heat loses.

Many years ago when coal burning furnaces were used, a manually operated damper was provided to control the draft from the furnace to the chimney. Later, with the use of oil burners the damper was removed because with the oil burner many times there might occur a small explosion especially when the burner was first ignited and if the damper were in a closed position, this explosive puff would be blocked and back firing would occur. Thus, the damper was removed.

However, with the use of an open exhaust vent or pipe, there is heat loss from the oil burner which reduces the effeciency of the burner.

Accordingly, an object of the present invention is to provide an energy saving device for use in association with an oil burner heating system.

Another object of the present invention is to provide a baffle structure for use in a vent pipe of a heating system which structure is normally in a closed position blocking a majority of the vent but which can be easily pivoted to a more open position upon the occurrence of any slight explosion or ignition from the oil burner.

SUMMARY OF THE INVENTION

To accomplish the foregoing and other objects of this invention, there is provided for preferably an oil burner having a vent pipe coupled to a chimney, a baffle structure that is normally positioned in a closed position blocking a majority of the cross-sectional area of the pipe. This baffle structure in the disclosed embodiment comprises three pivotal baffle plates which are commonly interconnected at their bottom end. For application to a horizontal vent pipe, these baffles assume a closed position by gravity and swing to a more open position upon the occurrence of an explosion or ignition creating a pressure wave that urges the baffle structure to this more open position.

There are some applications wherein the structure of this invention is more easily mounted in a vertical pipe section. The identical structure can be used with the addition of a stop fixed to an inner surface of the pipe which limits the baffle structure to a substantially horizontal position. When a pressure wave occurs, this baffle structure pivots upwardly to a more open position. Generally speaking, the baffle structure is constructed to be more light in weight for vertical applications than for horizontal applications.

DESCRIPTION OF THE DRAWINGS

Numerous other objects, features and advantages of the invention should now become apparent upon a reading of the following detailed description taken in conjunction with the accompanying drawings, in which:

FIG. 1A shows a heating system having the device of the present invention mounted in the vent pipe thereof;

FIG. 1B is a view similar to that shown in FIG. 1A with the device mounted in a vertical pipe section;

FIG. 2 is a cut-a-way view showing the baffle structure of the present invention in the position indicated in FIG. 1A; and FIG. 3 is a cross-sectional view taken along line 3—3 of FIG. 2.

DETAILED DESCRIPTION

FIG. 1A shows an oil burner which may comprise a gun 10 and a combustion chamber 12. This structure is of conventional design and there are many different types that are now in use. A vent pipe 14 extends from the combustion chamber to a vertical chimney 16. The chimney 16 may be constructed of a fire brick and typically has a base 18. The horizontal vent pipe 14 is shown with the baffle structure 20 disposed therein. The vent pipe 14 could actually be in separate sections with one of the sections containing the baffle structure 20.

In FIG. 1B like reference characters will be used to designate like parts with reference to FIG. 1A. Thus, FIG. 1B shows the gun 10, combustion chamber 12, and chimney 16. The vent pipe from the combustion chamber to the chimney includes a horizontal section 22 and a vertical section 24 which contains the baffle structure 20. In the embodiment shown in FIG. 1A there is also included a stop 26 secured to the wall of the section 24. This stop 26 limits the downward pivoting of the baffle structure 20.

FIGS. 2 and 3 show the pipe section 14 depicted in FIG. 1A. Of course, the structure shown in FIGS. 3 and 4 could also be mounted vertically as indicated in FIG. 1B. In FIGS. 2 and 3 there is shown the bracket 30 which is secured by sheet metal screws 32 to the inside of the pipe 14. Actually, as indicated in FIG. 3, there are two brackets 30 each of which has three V-shaped notches 34 from which the baffles 36 are supported. Each baffle includes two apertures 38 at the top thereof and a pair of links 40 support the two points of the baffle from the V-shaped notches of the bracket 30.

The baffle 36 also has an aperture 42 at the bottom to which is connected two other links 44, the bottom one of which passes through an aperture 46 in the elongated rod 48. The rod 48 actually receives three of these double link arrangements each one connecting from one of the three baffle plates 36.

The baffle plate 36 is preferably of the same shape as the pipe, slightly smaller than the pipe and has flat edges 50 on either side to permit maximum pivoting of the baffles. FIG. 2 shows, in phantom, the open position of the baffle plates when an ignition or explosion has occurred. FIG. 2 also shows the stop 52 which is secured to the inside wall of the pipe section 14 by suitable means such as one or more sheet metal screws.

FIG. 1A shows the device in a horizontal pipe and FIG. 1B shows it in a vertical pipe. The device may also be mounted in a slanted pipe section thus facilitating the need for the stop. Also, in FIG. 1B the device could also be mounted in the horizontal section rather than the vertical section.

Having described one embodiment for the baffle structure of this invention, it is obvious to those skilled in the art that numerous other embodiments exist all of which are contemplated as falling within the scope of the present invention as defined by the appended claims.

What is claimed is:

1. In combination, a furnace defining a combustion chamber having an output port for exiting exhaust gases from the combustion chamber, a chimney, a vent pipe coupling between the output port of the combustion chamber and the chimney, three baffle plates all being of the same size and shape, all being flat and having top and bottom ends that are arcuate or circular in shape following the same circular locus and sides that are straight to permit optimum swinging of the plates, each and every one of said baffle plates being closed in its central area and being constructed to cover an area greater than half the cross-sectional area of the pipe, a pair of elongated brackets each having three V-shaped notches, screws for securing the brackets in parallel and to the inside top of the pipe, the brackets being spaced from each other and disposed in side-by-side alignment, said baffle plates each having two spaced top holes therein and a bottom hole, a plurality of double ring supports some of which are for supporting the baffle plates from the brackets with each plate having two double ring supports interconnecting the V-shaped notches of adjacent brackets with the spaced top holes of the baffle plate, an elongated rod having holes spacedly disposed therealong, others of said plurality of double ring supports interconnecting, respectively, the bottom hole of each plate with the hole in the elongated rod thereby permitting all baffle plates to swing together being maintained in substantially parallel relationship regardless of their position, an L-shaped stop bracket having one leg secured to the inside bottom wall of the vent pipe and having an upright leg with a face surface for contacting an end of the elongated rod to limit the swinging of the baffles.

* * * * *